US005188095A

United States Patent [19]

Healy

[11] Patent Number: 5,188,095

[45] Date of Patent: Feb. 23, 1993

[54] PORTABLE VIBRATING PLATFORM

[75] Inventor: Charles D. Healy, Irvine, Calif.

[73] Assignee: C.S. Technology, Santa Ana, Calif.

[21] Appl. No.: 710,252

[22] Filed: Jun. 3, 1991

Related U.S. Application Data

[63] Continuation of Ser. No. 492,617, Mar. 12, 1990, abandoned.

[51] Int. Cl.[5] ..... A61H 1/00

[52] U.S. Cl. ..... 128/32; 128/41

[58] Field of Search ..... 128/41, 33, 32, 36, 128/64

[56] References Cited

U.S. PATENT DOCUMENTS

| | | | |
|---|---|---|---|
| 1,945,675 | 2/1934 | Binney | 128/41 |
| 2,604,091 | 3/1951 | Hansen | 128/41 |
| 2,949,108 | 8/1960 | Vecchio | 128/41 |
| 3,068,858 | 12/1962 | Suarez | 128/41 |
| 4,326,506 | 4/1982 | Kawabata | 128/41 |
| 4,873,966 | 10/1989 | Gitter | 128/33 |

*Primary Examiner*—Robert A. Hafer
*Assistant Examiner*—David J. Kenealy
*Attorney, Agent, or Firm*—Lyon & Lyon

[57] ABSTRACT

A very thin, self-contained, portable, vibrating platform having three major elements: 1) a platform structure constructed from thin (e.g., one half inch) plywood, particle board, or other suitable material, such that when assembled its top and bottom surfaces are completely smooth and all other components are contained and environmentally sealed within the envelope of the platform; 2) a very thin (e.g., 0.4 inches) electromagnet designed to be connected to a source of alternating current; 3) a ferrous metal rod mounted in close proximity to the magnet such that the rod will be attracted to the magnet when current is applied. The rod is attached to the platform in a manner such that it will preferably physically resonate at, or near, the same frequency as the applied alternating current and thereby amplify and induce kinetic forces into the platform structure causing the entire platform to vibrate.

9 Claims, 6 Drawing Sheets

PORTABLE VIBRATING PLATFORM

This is a continuation of co-pending application Ser. No. 07/492,617, filed on Mar. 12, 1990, abandoned.

This invention relates to vibration systems, and more particularly, to a portable self-contained low cost, low energy system for use as a body or foot massager, and for other applications where space or budget constraints make conventional vibrators impracticable or undesirable to use.

BACKGROUND OF THE INVENTION

It is well known that three basic types of electrically driven vibrators generally exist. They are the environmental laboratory shaker, the concentric weight driven by a motor, and the electromagnet.

The environmental laboratory type shaker is analogous to a very large high fidelity speaker. The level and frequency of the vibration is determined by a control unit that drives the shaker through a powerful amplifier. Small test samples may be mounted directly to the shaker head. Larger samples are bolted to a slip-plate which in turn is usually supported by an oil bearing mounted on a concrete block. The shaker head is attached to the slip-plate which then drives the slip-plate. This system is capable of a wide range of levels and frequencies. It is expensive to acquire and to operate, and it is bulky. Once installed, it is moved only with great difficulty and expense.

The concentric weight vibrator comprises an electric motor with an offset weight or weights mounted to its output shaft. The rotating unbalanced shaft causes the entire motor to vibrate. The device may be mounted to anything having sufficient strength to sustain the weight and vibration and having sufficient room to accommodate its bulk. The frequency of vibration is dependent on the speed of the motor, while the level of vibration is determined by the amount of offset of the weight and the amount of weight, as well as motor speed. This unit has many applications. Larger units are used in industry on polishing, deburring and grinding equipment, and on parts conveyers, while smaller units are used in home massage equipment such as vibrating beds and chairs, as well as foot massagers. In the latter case, any unit using this type of vibrator must be thick enough to accommodate its bulk. Even miniature motors require space that prevents the development of a low profile platform preferably of less than one-half to one inch thick.

The electromagnet type vibrator comprises a coil of wire wound on a core of permeable metal and an armature. When current is applied to the coil a magnetic field is generated. The coil is located in close proximity to a ferrous metal armature that is attracted toward the magnetic field. When the electric current stops, the magnetic field collapses and the metal armature returns to its original position. The level of the vibration is dependent on the amount of current through the coil while the frequency is determined by the on-off cycle of the current. In most applications current is supplied by a 115V a.c. line. A diode is connected in series with the coil, thus providing a pulsating current at 60 hertz. This vibrator is used in many of the same applications as the concentric weight vibrator, and with the same limitations.

SUMMARY OF THE INVENTION

While the foregoing types of electrically driven vibrators provide many useful functions, none is suitable for providing a relatively simple, inexpensive, and particularly important, relatively thin vibrating platform, and which can be relatively compact and lightweight and thus, portable. A portable vibrating platform of this nature would be particularly useful as a platform to stand on at a booth in a trade show or convention, supermarket checkout stand, guard shack, and numerous other places where a person or persons must stand for long periods of time. However, all of the previously described and available devices have been too bulky, large, heavy, cumbersome, and the like for this purpose.

According to the present invention, and exemplary embodiments thereof to be described below, a relatively simple and compact vibrating platform is provided and which basically comprises a base or board structure, an elongated resonating metal rod mechanically coupled to this structure, and a very thin and relatively small electromagnet to excite the metal rod to vibrate. A very thin and portable vibrating platform, as thin as one half inch thick or less, can be provided according to the present invention and exemplary embodiments thereof, and which provides a gentle massaging action to the feet of the person standing thereon, as well as a similar vibrating action to any object (eg., chair, bed, etc.) touching or placed on the platform. The thus described platform has numerous other uses where a gentle massaging or vibratory action is desired.

Accordingly, it is a principal object of the present invention to provide a new form of vibrating device.

A further object of the present invention is to provide a relatively simple and thin vibrating platform.

Another object of the invention is to provide a portable vibrating platform having a maximum thickness of approximately one half inch and which has a self-contained vibratory system comprising an elongated resonating metal rod which is excited by a very thin electromagnet.

A further object of this invention is to provide a new form of vibratory source using a relatively small and thin electromagnet in combination with a relatively long metal rod.

A still further object of the present invention is to provide an improved method of generating vibrations.

These and other objects and advantages of the present invention will become better understood through a consideration of the following description, taken in conjunction with the drawings in which.

DETAILED DESCRIPTION

Figure 1:
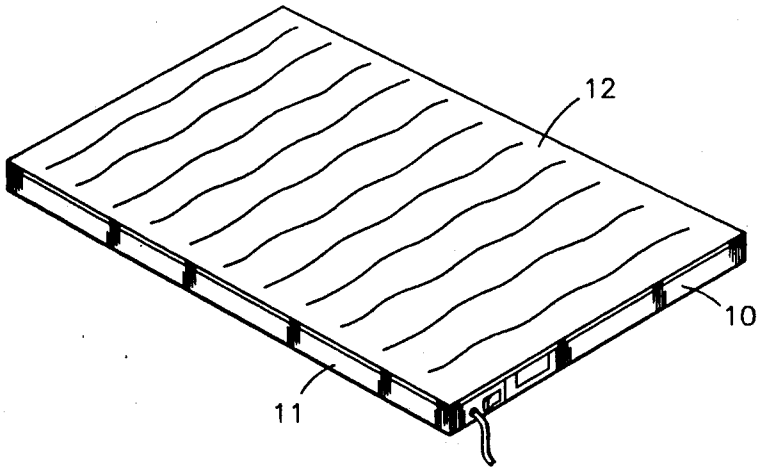
FIG. 1 is a simplified perspective view of a portable vibrating platform according to the present invention.

Turning now to the drawings, and first to FIGS. 1-3, FIG. 1 shows a simplified perspective view of a portable vibrating platform according to the present invention. The platform includes a base or body 10 having a shunt channel 11 coupled therewith, and a resilient pad or cover 12. According to an exemplary embodiment of the concepts of the present invention, the platform assembly of FIG. 1 may be approximately eighteen inches wide, thirty inches long, and one half inch thick (plus, the thickness of the resilient cover 12.) A vibrating platform of this size is particularly useful to minimize or eliminate fatigue at trade shows, conventions, and the like where a person must stand in one place for prolonged periods of time. It provides a low-profile vibration device which, through vibration provides a gentle massaging action, and stimulates the nerve endings in the feet and legs of the person or persons standing on the platform. This action alleviates some of the tiredness in the feet and legs, and more importantly, can help create a more positive attitude so that the person can think, work, and function better. Other applications include those in the general workplace, such as supermarket checkout stands, guard shacks, machine shops, barber or beauty shops, hotel front desks, fast food outlets, and virtually any place where people are required to stand for long periods of time. An optional heating element (not shown) also can be provided. Even the legs of a chair or bed may be placed on the platform too, in effect, creating a vibrating chair or vibrating bed. Parts containers or the like can be placed on the platform to provide an appropriate agitating action.

Figure 2A:
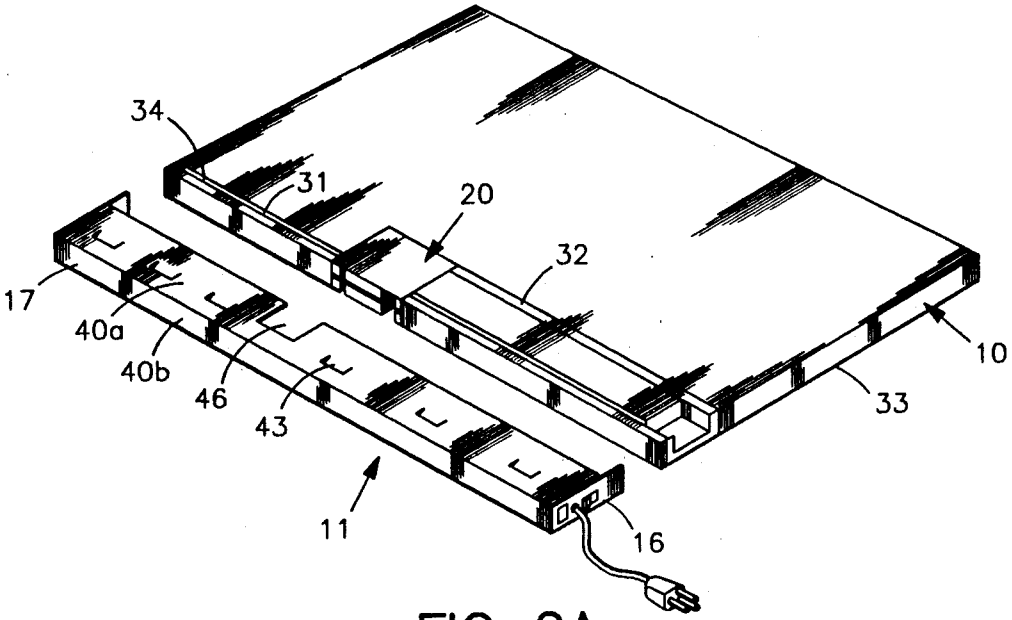
FIG. 2A is an exploded perspective view of the platform with a padded cover removed.
Figure 2B:
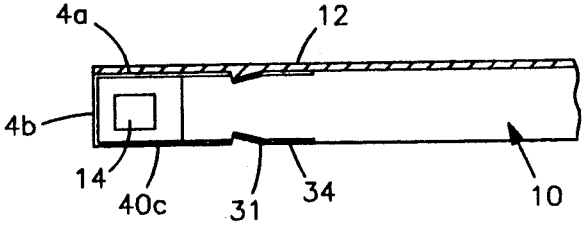
FIG. 2B is a cross-sectional view taken along a line A—A of FIG. 2A.

Turning now to FIGS. 2 and 3, FIG. 2A shows an exploded perspective view of the vibrating platform with the cover 12 removed. The base or board 10 may be formed of wood, and the shunt channel 11 formed of metal. The function of the shunt channel 11 is to house and hold a resonating metal rod 14 extending the length of the channel 11 and to couple the vibrations of this rod to the body 10 The rod is secured at its ends to the respective ends 16 and 17 of the shunt channel 11 The magnet assembly 20 is mounted in a cavity in the base 10 and secured thereto. When the shunt channel 11 is attached to the base 10, the magnet is in close proximity (eg., 0.1 inch) to the metal rod 14 so that the rod 14 effectively functions as an armature which vibrates. The electromagnet 20 is very thin, and its structure and relationship with the rod 14 allow the thin, compact, lightweight and portable vibrating platform to be provided.

Thus, the basic components of the present portable vibration platform are a base 10, electromagnet 20 disposed in the base, a relatively long resonating metal rod 14, and a support and Vibration coupler (shunt channel 11) for the rod. The rod 14 is disposed in close proximity to the electromagnet 20, and is held by the support member 11 which is usually referred to herein as a shunt channel. The shunt channel supports the elongated metal rod 14 at the ends of the rod, and the shunt channel is coupled to the base 10. Accordingly, the electromagnet 2, when appropriately energized vibrates the rod 14, the ends of the rod are fixed to the shunt channel 11 and, therefore, transfer vibrations from the rod to the channel, and the shunt channel transmits the vibrations to the base 10 which serves as the primary means of transmitting the vibrations to the person standing on it or to any other suitable object.

The platform uses the resonating metal rod 14 excited by the Very thin electromagnet 20, and both the rod 14 and electromagnet 20 can be contained and sealed within a one half inch thick platform assembly. When activated, the platform becomes a vibrating structure capable of inducing kinetic energy into any object placed on, or coming into contact with its surface. An optional heating element (not shown), can also provide heat with vibration. The platform may also be used to induce vibration into objects neither on nor in direct contact with its surface via the use of any pliable or liquid media capable of conducting the energy, such as carpet, foam rubber pads, water, solvents, and the like. Although the rod 14 is shown preferably disposed along one edge of the platform, it can be arranged in the middle or elsewhere in the platform.

Figure 3A:
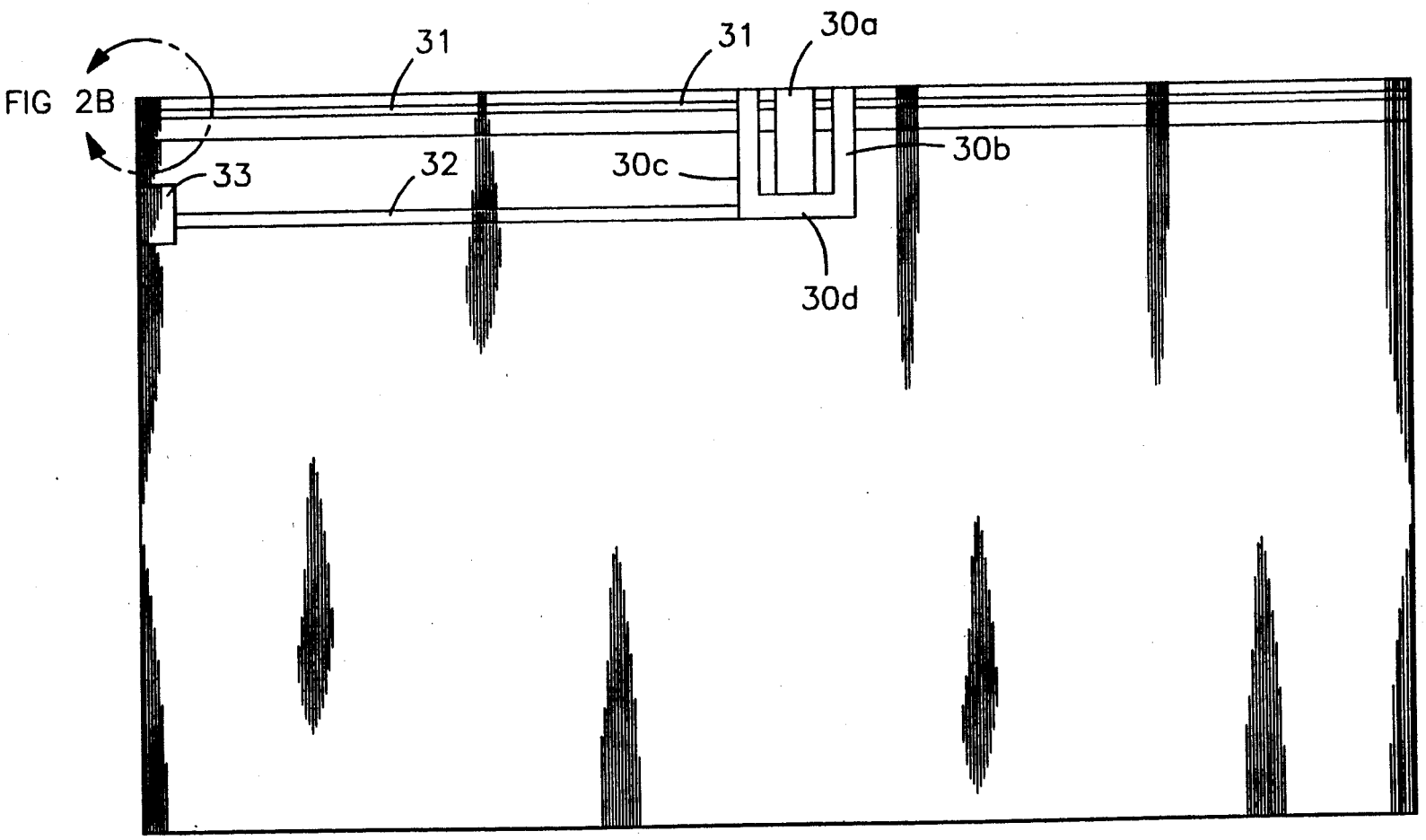
FIGS. 3A and 3B illustrate details of the base or board structure of the platform.
Figure 3B:
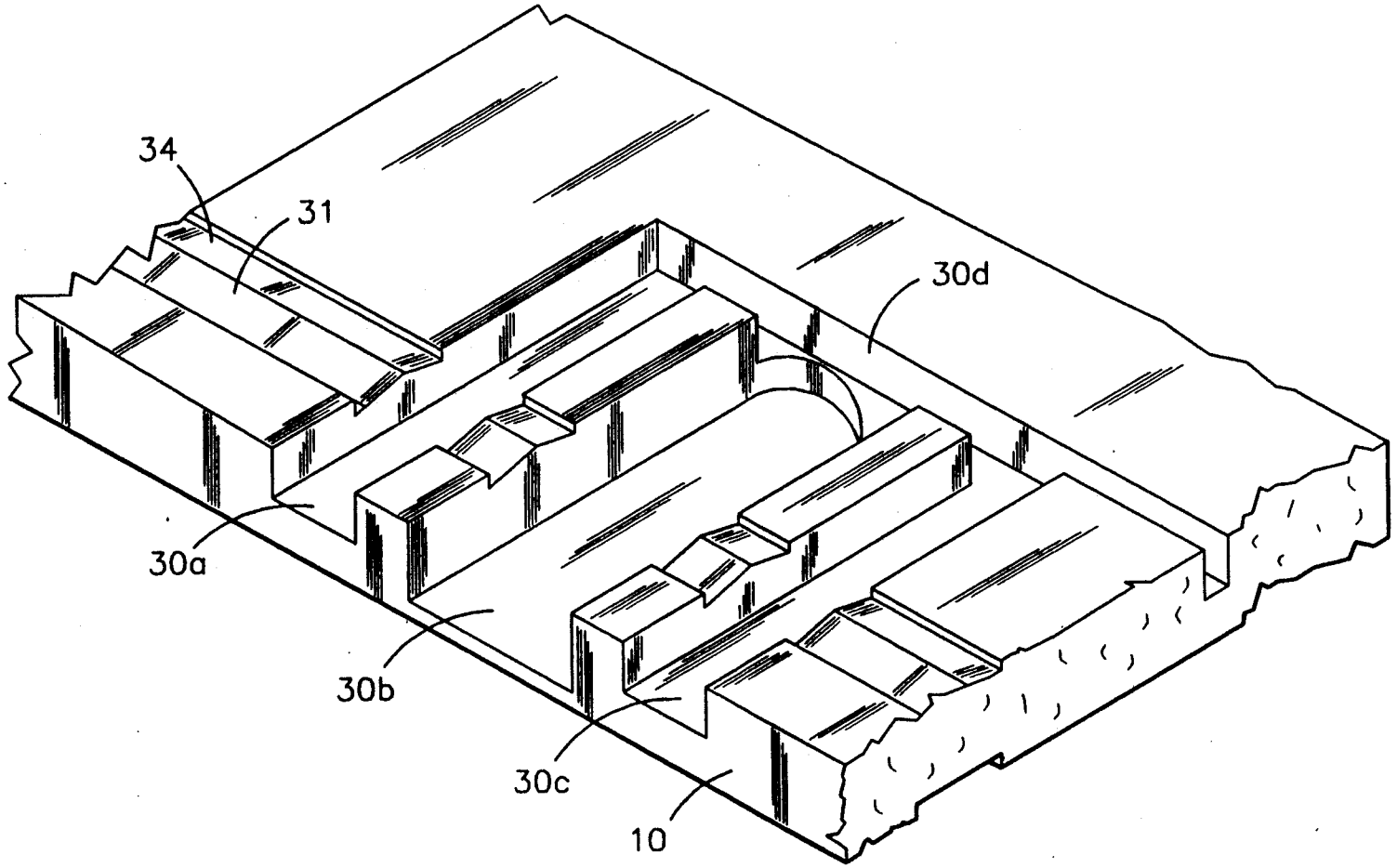

Turning again to the drawings, and particularly FIGS. 2 and 3, the platform structure 10 is fabricated from a good grade of one half inch plywood or MDF type particle board cut to thirty by seventeen and one-half inches. It should be noted that the thirty inch length dimension is used so as to accommodate a sufficiently long resonating rod 14 to resonate at about forty-five to sixty hertz. If a different frequency is to be used this dimension can be adjusted. The mounting arrangement and characteristics of the rod 14 may also be adjusted. The Width dimension is not critical. Router cuts as best seen in FIGS. 3A and 3B are made in the board 10 in order to accept the electromagnet 20, shunt channel assembly 11 and electrical hookup wire (see FIG. 3A). If additional components such as heating elements, control devices, a.c. accessory outlets, or any other devices are to be installed within the envelope of the platform, additional router cuts can be made.

In reference to FIG. 5, the electromagnet assembly 20 is comprised of 32 gauge polyurethane insulated magnet wire wound into a coil 74 on a spool formed from a one and one-half inch diameter DOW Corning heat shrink tubing 73 (see FIG. 5D) as will be described in more detail below. A stack of Temple Steel Company Grade m-6 EI-8/0117 transformer laminations 80, fourteen layers thick is inserted into the center of the coil 74. Hookup wire and a diode may be included. The entire assembly is then encapsulated in lacquer. The construction of this assembly will be described in detail later.

Considering the base 10 of the platform in more detail, and with particular reference to FIGS. 2 and 3, channels 30 are cut for receiving the electromagnet 20 as seen in FIGS. 3A and 3B, elongated grooves 31 are formed on both sides of the board 10 as seen in FIGS. 3A and 2A to receive tabs of the shunt channel 11 Which will be described in greater detail subsequently, a groove 32 is formed for receiving the lead wires of the coil of the electromagnet, and an opening 33 is formed to receive an AC switch, plug or the like. The groove 31 is approximately 0.1 inch deep. An area 34 is planed down On both sides **40*a* and 40*c* of the channel 11. This area 34 is approximately one inch wide (note FIG. 3B) by thirty thousandths inch deep. The electromagnet 20, its lead wires, switch and the like are glued or foamed in place in the board 10** after they have been installed.

Figure 4A:
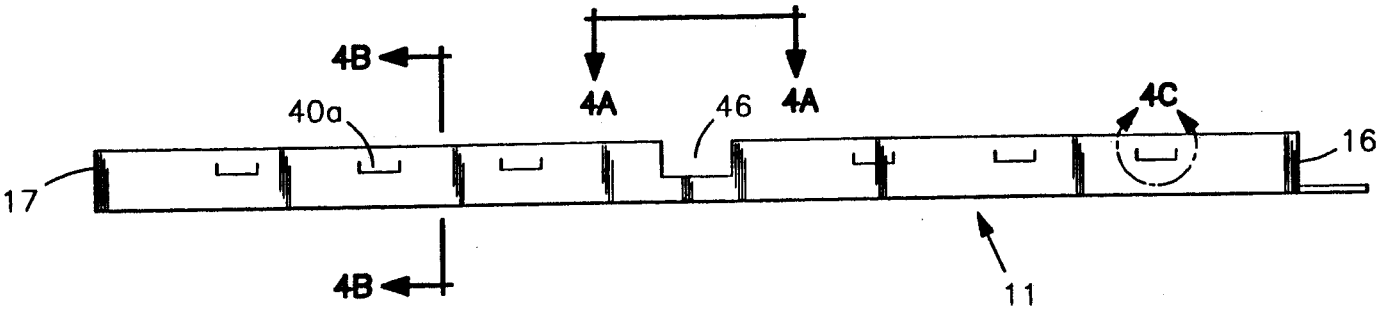
FIGS. 4A-4C illustrate details of a shunt channel of the platform, with FIG. 4B being a cross-sectional view along a line A—A of FIG. 4A FIGS. 5A-5C illustrate in detail a thin electromagnet assembly; and, FIG. 5D illustrates a core structure for forming a thin coil for the electromagnet.
Figure 4A:
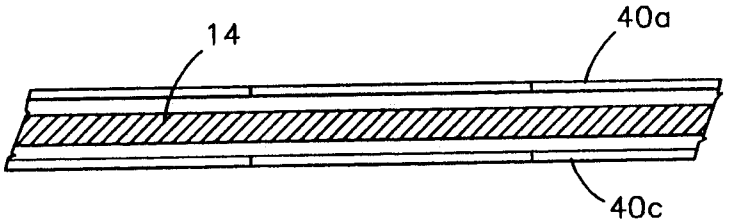
Figure 4B:
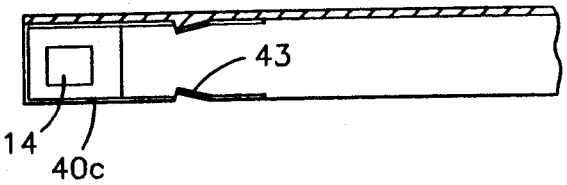
Figure 4C:
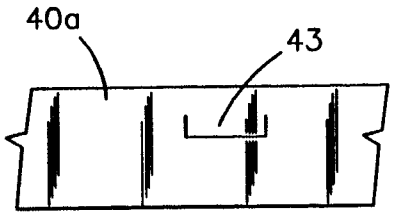

Turning now to the details of the shunt channel assembly 11, the same essentially comprises a generally "U" shaped channel having closed ends 16 and 17, and is formed of metal as best seen in FIGS. 2A-2B and 4A-4C. The elongated resonating metal rod is disposed in the the channel. The channel 11 preferably is formed from 22 gauge steel and comprises top, bottom and front sections 40A, 40B, and 40C, and end sections 16 and 17. The elongated metal rod 14 preferably comprises a one-fourth inch square hot rolled ASTM 36 steel rod, with its ends welded to the respective ends 16 and 17 of the channel 11. The top and bottom sections 40A and 40C of the channel 11 include a plurality of tabs 43 cut into these sections and which clip into the grooves 31 on the top and bottom of the board 10. Typically, these tabs can be about one inch long, about one-fourth inch wide and extend downwardly about three thirty-seconds of an inch. The top and bottom sections 40A and 40C have a small cutout 46 as best seen in FIG. 4A, preferably about one and three fourth inches long, where the channel 11 would overlie the magnet 20. This cutout 46 prevents the metal channel 11 from shunting and reducing the magnetic field of the electromagnet 20. A suitable adhesive further secures the shunt channel 11 to the board 10.

Figure 5A:
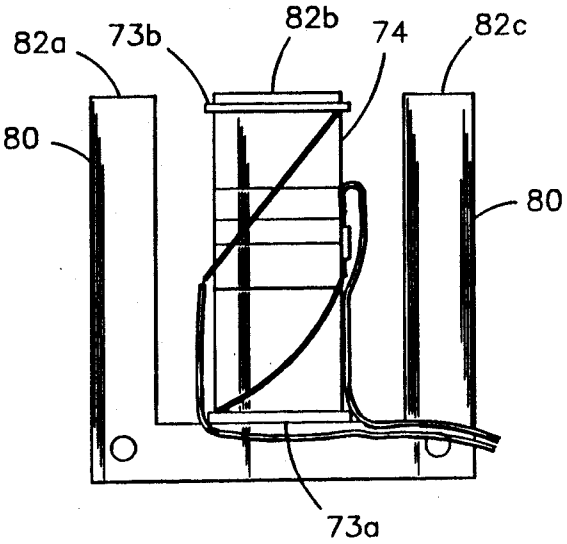
Figure 5C:
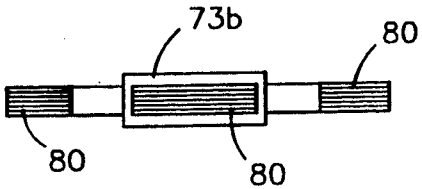
Figure 5B:
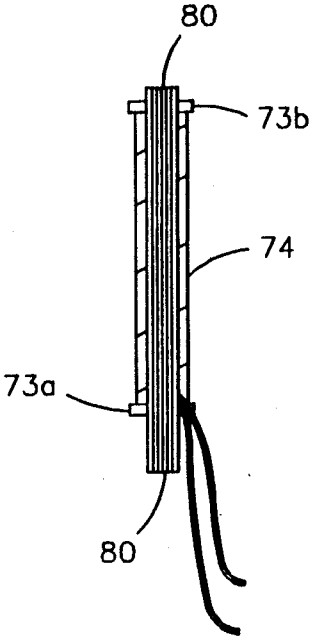

It is noted that the elongated metal rod 14 is attached only at its ends to the shunt channel 11, and is disposed in the channel, and the channel is disposed with respect to the base 10, so that a gap of approximately one tenth inch exists between the face of the rod and the facing pole pieces 82A–82C of the laminated core of the electromagnet 20. A similar gap exists between the faces of the rod and the interior walls of shunt channel 11, and allows sufficient room for the rod to vibrate upon excitation by the electromagnet 20. In a preferred embodiment, the width of the electromagnet 20 (the distance between the outside edges of pole pieces **82*a* and 82*c* as seen in FIG. 5A) is approximately three and five-eighths inches and the rod 14** is approximately thirty inches, a ratio of over eight to one.

It was noted above that preferably the electromagnet and lead wires are foamed in place. It is particularly important that the foam is not allowed to flow into the shunt channel such that it would interfere with vibration of the rod 14. Furthermore, preferably, a layer of resin soaked in fiberglass is placed on both sides of the platform over the electromagnet 20 to provide additional protection to the electromagnet 20 and to seal the area at the top and bottom of the platform above and below where the electromagnet enters the shunt channel 11. The entire platform can then be primed and painted in order to seal and protect it from moisture. Also, the top of platform preferably is covered with a suitable resilient mat or layer 12 (note FIG. 1).

No spools of the dimensions necessary to construct the coil 74 of the electromagnet 20 have been found to be available. Therefore, a spool must be specially created to meet the 0.4 inch thickness requirement (note FIG. 50). First a spool form or core 70 is constructed from particle board or wood (see FIG. 5D). The ends 71 and 72 of the form are removable so that the finished coil (see 74 in FIGS. 5A–5C) may be pushed off of the form 70 after heat has been applied. The form may be waxed to facilitate removal of the coil 74.

The actual fabrication of the coil is accomplished by cutting a piece of heat shrink tubing (see 73 in FIGS. 5D) to a length of approximately three and three-fourths inches, and placing the form 70 inside the tubing. The form and tubing 73 are then placed in an oven set for a suitable temperature, such as 350 degrees F. After the tubing has recovered to its minimum size, its end flanges **73*a* and 73*b*** are trimmed to approximate final dimensions.

Figure 5D:
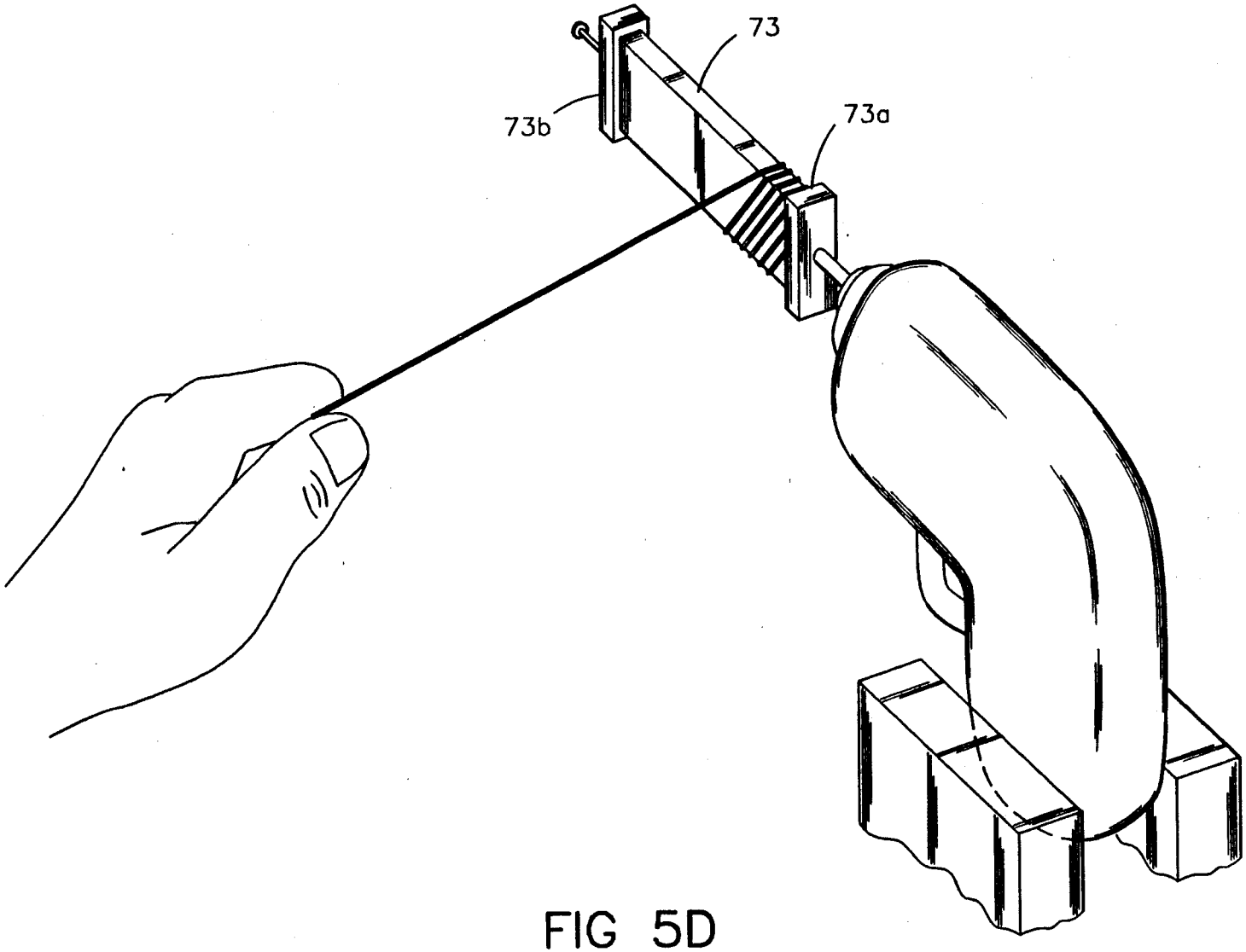

The coil then is then wound using the spool 70 and tube 73 assembly (with the form left in the tube for support) by inserting screws 76 and 77 in the ends of the form 70 to form a shaft. One screw 76 or 77 is placed in a support (not shown) and the other is placed into the chuck of a conventional variable speed electric drill as shown in FIG. 5D. At least six inches of the free end of the coil wire is secured to the end 71 of the form 70 with tape. Using the drill motor, the coil wire is layered on the length of the spool until the coil has reached a total thickness of 0.4 inches. The ends of the coil wire are cut to a length of four inches and secured with electrical tape. The assembly is then removed from the drill. The ends 71 and 72 of the form 70 are removed, and the spool/coil combination is removed from the form. The spool flanges **73*a* and 73*b* may now be trimmed to a final 0.4 inch width (see FIG. 5C**).

If a diode is to be installed internal to the vibration structure, it may be soldered to one of the coil wires. Also 24 gauge insulated hookup wire is soldered to the coil wire ends or to the unattached diode lead if a diode is used. The coil windings, diode if used, and hookup leads are secured with several wraps of electrical tape. Total thickness of the coil should not exceed 4 inches as measured through its smallest dimension (See FIG. 5C) so as to minimize the thickness of the finished platform.

Final assembly comprises inserting fourteen transformer laminations so into the center of the coil 74, then dipping the entire assembly into lacquer and allowing it to dry.

Various methods may be used in mounting or supporting the completed vibration platform on either a smooth surface, or an uneven or energy absorbing surface such as a carpet or rug. For use on hard surfaces, flexure type support can be provided by adhesive backed bumper pads or screw-attached vibration isolators mounted to the platform.

For uneven or soft surfaces such as carpets or rugs, adjustable chairs or table levelers may be installed to hold the platform above the nap. In any instance, caution must be exercised so that the installation of the screw-attached isolators or levelers does not damage any of the components mounted within the platform.

When the vibration platform is used as a stand-on foot massager, it is desirable to provide various coverings (note 12 in FIGS. 1 and 2B) in order to provide traction and improve the appearance. Also, the edges of the platform may be beveled. With the exceptions noted below, any floor covering, including antistatic coverings, may be used so long as the method of attachment to the platform does not indiscriminately use nails, tacks or other devices that penetrate the surface of the platform and damage the components contained therein. Permanent installation of a covering may be accomplished by use of adhesives. Temporary installation can be made by the use of double-backed carpet tape. If an optional heating element is installed, consideration must be given to the temperature specifications of the materials used.

Control of the vibration level of the vibration platform may be accomplished by varying the current through the electromagnet 20. This may be achieved by any number of means, including, but not limited to, mechanical or electronic on/off switches, rheostats or variacs, as well as control accelerometers providing feedback to a variably controlled amplifier or oscillator, such devices being installed either internal or external to the platform structure.

The phenomenon of resonance, as utilized by the present invention, produces an efficient system. The average power consumption of this device has been calculated at fifty hertz, which is a few hertz above resonance, and found to be less than five watts; yet the device is capable of inducing adequate energy into a three hundred pound load. This efficiency allows the size of the electromagnet to be sufficiently small such that it can be contained within a vibration platform of one-half inch and, therefore, makes the self-contained, portable vibration platform possible.

Although embodiments of the present invention have been shown and described, and various dimensions, sizes, materials and the like have been given, the same are not intended to limit the scope of the present invention, and the invention is intended to be defined as broadly as possible by the claims and to encompass all possible equivalents.

What is claimed is:

1. A vibrating platform comprising a rigid base member for providing a supporting platform of sufficient size to allow a person to stand thereon, an electromagnet mounted in a cavity formed in the rigid base member, an elongated metal rod disposed adjacent the electromagnet, the elongated metal rod being acted upon directly by a magnetic flux generated by the electromagnet, and being sized and dimensioned to resonantly vibrate at a desired frequency when the electromagnet is electrically energized, and elongated channel means fixed to the ends of the elongated metal rod for mounting the elongated metal rod closely adjacent the electromagnet, the elongated channel means being attached to the rigid base member for coupling vibrations of the elongated metal rod to the rigid base member.

2. A platform as in claim 1 wherein said base member is approximately thirty inches long, seventeen and one half inches wide, and one half inch thick.

3. A platform as in claim 1 wherein said metal rod has a length of approximately thirty inches and has a thickness of approximately one fourth inch, and said channel means disposes a surface of the rod approximately one-tenth inch from the ends of the poles of the electromagnet.

4. A platform as in claim 1 wherein said electromagnet is less than one half inch thick.

5. A platform as in claim 1 wherein the metal rod is substantially larger than the width of the electromagnet.

6. A method of providing vibrations to create a gentle massaging action for the feet of a person comprising the steps of providing a rigid platform member upon which a person can stand, vibrating an elongated metal rod with an electromagnet, the elongated metal rod being mounted in a cavity in the rigid platform member, disposed adjacent the electromagnet, and being acted upon directly by a magnetic flux generated by the electromagnet, and the elongated metal rod having a length functionally related to the frequency of a pulsating electric current applied to the electromagnet such that the elongated metal rod vibrates resonantly with the frequency of the pulsating electric current, and coupling the vibrations from the elongated metal rod to the rigid platform member to enable vibrations to be imparted to the feet of a person standing on the rigid platform member.

7. The vibrating platform as in claim 1 wherein said desired frequency is between about forty-five and sixty hertz.

8. A vibrating platform comprising a rigid base member for providing a supporting platform of sufficient size to allow a person to stand thereon, an electromagnet mounted in a cavity formed in the rigid base member, an elongated metal rod disposed adjacent the electromagnet, the elongated metal rod being acted upon directly by a magnetic flux generated by the electromagnet, and being sized and dimensioned to resonantly vibrate at a desired frequency when the electromagnet is electrically energized, elongated channel means fixed to the ends of the elongated metal rod for mounting the elongated metal rod closely adjacent the electromagnet, the elongated channel means being attached to the rigid base member for coupling vibrations of the elongated metal rod to the rigid base member, and a plurality of vibration isolating support members coupled to the rigid base member, to provide support to the rigid base member, and to separate the rigid base member from a flooring surface.

9. A vibrating platform comprising a rigid base member for providing a supporting platform of sufficient size to allow a person to stand thereon, the rigid base member being approximately thirty inches long, seventeen and one half inches wide, and one half inch thick, an electromagnet mounted in a cavity formed in the rigid base member, the electromagnet having a maximum thickness of less than one half inch, an elongated metal rod disposed adjacent the electromagnet, the elongated metal rod being acted upon directly by a magnet flux generated by the electromagnet, having a length of approximately thirty inches and a thickness of approximately one fourth inch, and vibrating resonantly at a frequency between forty-five and sixty Hz when the electromagnet is electrically energized, elongated channel means fixed to the ends of the elongated metal rod for mounting the elongated metal rod approximately one-tenth inch from the ends of the poles of the electromagnet, the elongated channel means being attached to the rigid base member for coupling vibrations of the elongated metal rod to the rigid base member, and a plurality of vibration isolating support members coupled to the rigid base member, to provide support to the rigid base member, and to separate the rigid base member from a flooring surface.

* * * * *